US011022406B2

(12) United States Patent
Rice

(10) Patent No.: US 11,022,406 B2
(45) Date of Patent: Jun. 1, 2021

(54) INCONSPICUOUS DEFENSE SUBSTANCE SPRAY CANISTER

(71) Applicant: Adrian Rice, Plymouth, MI (US)

(72) Inventor: Adrian Rice, Plymouth, MI (US)

(73) Assignee: Adrian Rice, Plymouth, MI (US)

( * ) Notice: Subject to any disclaimer, the term of this patent is extended or adjusted under 35 U.S.C. 154(b) by 0 days.

(21) Appl. No.: 16/675,981

(22) Filed: Nov. 6, 2019

(65) Prior Publication Data

US 2020/0141702 A1 May 7, 2020

Related U.S. Application Data

(60) Provisional application No. 62/756,187, filed on Nov. 6, 2018.

(51) Int. Cl.
*F41H 9/10* (2006.01)

(52) U.S. Cl.
CPC ..... *F41H 9/10* (2013.01)

(58) Field of Classification Search
CPC ..... F41H 9/10; F41H 11/00; B65D 83/22; B65D 83/201
USPC ..... 222/402.1, 402.11, 402.13, 402.15, 78, 222/79, 325
See application file for complete search history.

(56) References Cited

U.S. PATENT DOCUMENTS 3,610,480 A * 10/1971 Lipfert ..... A61M 15/009 222/402.21
3,756,467 A * 9/1973 Anketell ..... F41H 9/10 222/78
5,310,086 A * 5/1994 Julinot ..... B65D 83/384 222/1
5,366,118 A * 11/1994 Ciammitti ..... B65D 83/386 222/153.1
6,951,070 B2 10/2005 Fleischhauer et al.
7,922,041 B2 * 4/2011 Gurrisi ..... B65D 83/384 222/153.11

(Continued)

FOREIGN PATENT DOCUMENTS

DE 10033627 A1 1/2002

OTHER PUBLICATIONS

Amazon.com, "Guard Dog AccuFire Pepper Spray with Laser Sight Top: Sports & Outdoors," accessed Nov. 6, 2019.

(Continued)

*Primary Examiner* — Lien M Ngo
(74) *Attorney, Agent, or Firm* — Quinn IP Law

(57) ABSTRACT

An defense substance spray canister is provided. The defense substance spray canister includes a cylindrical outer tube defining a longitudinal axis of the defense substance spray canister through an axial center of the cylindrical outer tube, a defense substance storage container contained within the cylindrical outer tube, the defense substance storage container including a valve operable to selectively release a flow of defense substance, an activation sleeve centered upon the longitudinal axis and, based upon relative movement of the activation sleeve relative to the cylindrical outer tube, operable to activate the valve, and a sleeve force transmission assembly operable to transform the relative movement of the activation sleeve relative to the cylindrical outer tube into an activation force upon the valve operable to selectively release the flow of defense substance.

11 Claims, 6 Drawing Sheets

(56) References Cited

U.S. PATENT DOCUMENTS

| | | | | |
|---|---|---|---|---|
| D731,172 | S | 6/2015 | Atteberry et al. | |
| 10,479,592 | B1 * | 11/2019 | Caruso | B65D 83/22 |
| 2006/0191525 | A1 | 8/2006 | Dai | |
| 2014/0048561 | A1 * | 2/2014 | Mangold | F41C 27/00 222/153.11 |
| 2016/0018194 | A1 | 1/2016 | Childs et al. | |
| 2017/0108310 | A1 | 4/2017 | Zimmerman | |

OTHER PUBLICATIONS

MidwayUSA.com, "ASP Palm Defender Pepper Spray 3 Gram Aerosol Aerospace Aluminum Body Includes Key Ring 10% OC", accessed Nov. 6, 2019.

* cited by examiner

FIG. 4
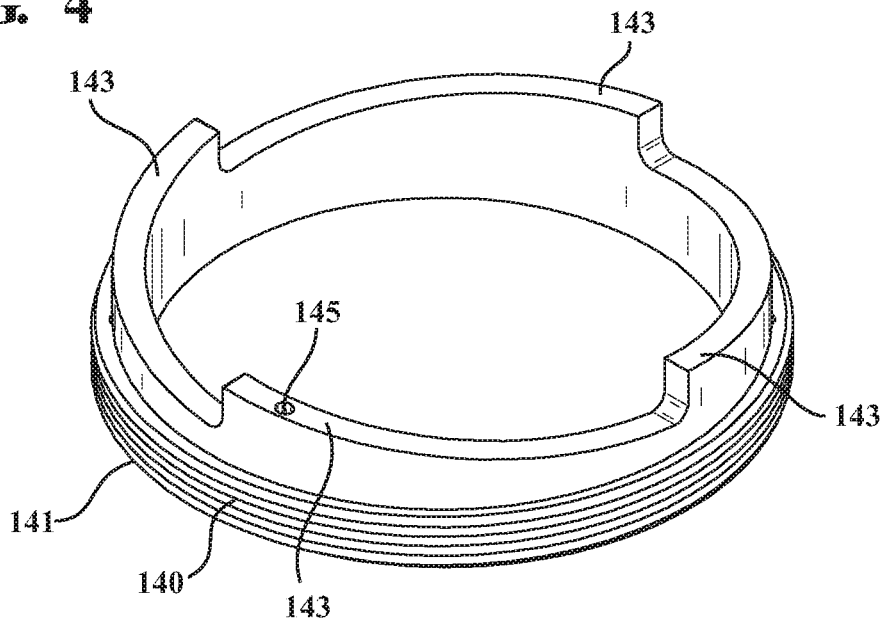
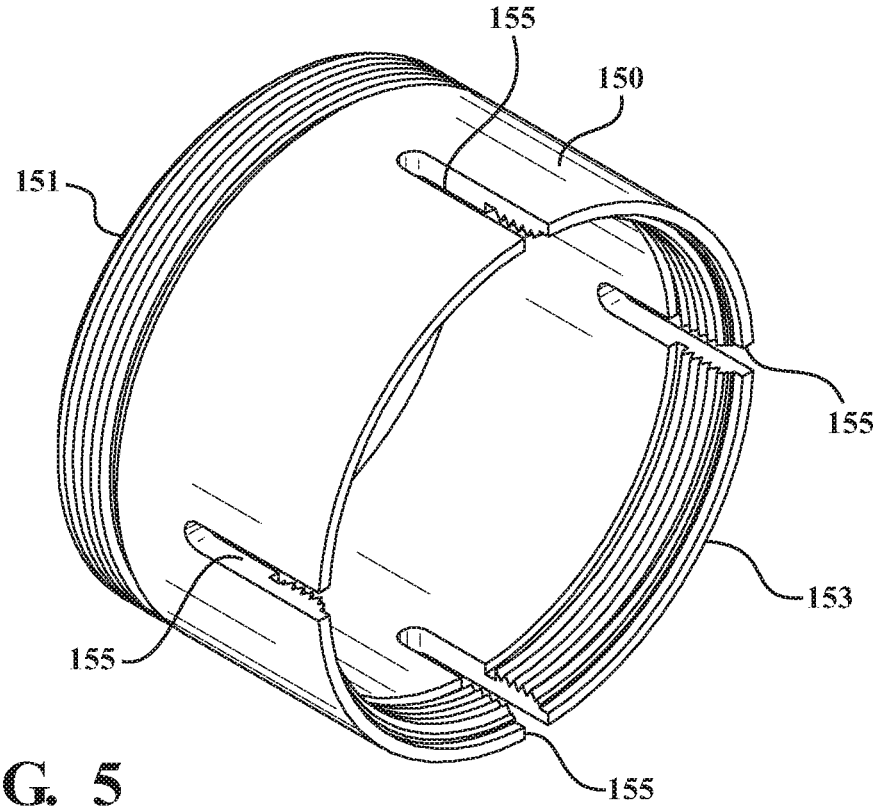
FIG. 5

INCONSPICUOUS DEFENSE SUBSTANCE SPRAY CANISTER

CROSS REFERENCE TO RELATED APPLICATIONS

This disclosure claims the benefit of U.S. Provisional Application No. 62/756,187 filed on Nov. 6, 2018 which is hereby incorporated by reference.

INTRODUCTION

The disclosure generally relates to an inconspicuous defense substance spray canister.

Defense substance canisters can be used to deter an attacker, wherein a user can squeeze a trigger and a spray or a gel projectile is released from a front of the canister. Such devices typically include a visible pressure tank, the trigger mechanism, and a visible nozzle.

SUMMARY

Defense substance canisters including the visible mechanisms for releasing defense substance look like a weapon. Such devices can be deemed inappropriate for storage in plain sight in sensitive areas such as a classroom, in which a weapon-like device can be scary or intimidating. However, access to a self-defense device in classrooms or other similar settings can be lifesaving.

A defense substance spray canister is provided. The defense substance spray canister includes a cylindrical outer tube defining a longitudinal axis of the defense substance spray canister through an axial center of the cylindrical outer tube, a defense substance storage container contained within the cylindrical outer tube, the defense substance storage container including a valve operable to selectively release a flow of defense substance, an activation sleeve centered upon the longitudinal axis and, based upon relative movement of the activation sleeve relative to the cylindrical outer tube, operable to activate the valve, and a sleeve force transmission assembly operable to transform the relative movement of the activation sleeve relative to the cylindrical outer tube into an activation force upon the valve operable to selectively release the flow of defense substance.

In some embodiments, the sleeve force transmission assembly includes a rotation-based torque transmission assembly operable to transform a torque applied to the activation sleeve into the activation force upon the valve.

In some embodiments, the rotation-based torque transmission assembly includes an activation pin operable to apply the activation force upon the valve, an actuator plate attached to the activation pin, and a cam ring rotationally attached to the activation sleeve and including at least one slanted ramp, wherein, when the cam ring is rotated, the slanted ramp acts upon the actuator plate and causes the activation pin to apply the activation force upon the valve.

In some embodiments, the activation pin includes a hollow center, and the flow of defense substance is channeled to exit the valve and enter the hollow center.

In some embodiments, the activation pin includes a nozzle operable to direct the flow of defense substance into an effective flow pattern outside of the defense substance spray canister.

In some embodiments, the rotation-based torque transmission assembly further includes a torsion spring operable to bias the activation sleeve into a non-activated state.

In some embodiments, the sleeve force transmission assembly includes a rotation-based torque transmission assembly operable to transform rotation of the activation sleeve relative to the cylindrical outer tube into the activation force upon the valve.

In some embodiments, the cylindrical outer tube includes a removeable bottom cap.

In some embodiments, the sleeve force transmission assembly includes a longitudinal-based force transmission assembly.

In some embodiments, the longitudinal-based force transmission assembly transforms longitudinal movement of the activation sleeve into the activation force upon the valve operable to selectively release the flow of defense substance.

In some embodiments, the longitudinal-based force transmission assembly includes two pivoting arms connected to the activation sleeve, a translating actuator member connected to the two pivoting arms, and an activation pin operable to apply the activation force upon the valve based upon movement of the translating actuator member.

In some embodiments, the defense substance storage container contains oleoresin capsicum.

In some embodiments, the defense substance storage container contains tear gas.

According to one alternative embodiment, a defense substance spray canister is disclosed. The defense substance spray canister includes a cylindrical outer tube defining a longitudinal axis of the defense substance spray canister through an axial center of the cylindrical outer tube, a defense substance storage container contained within the cylindrical outer tube, the defense substance storage container including a valve operable to selectively release a flow of defense substance, an activation sleeve centered upon the longitudinal axis and, based upon relative rotation of the activation sleeve relative to the cylindrical outer tube, operable to activate the valve, and a rotation-based torque transmission assembly operable to transform the relative rotation of the activation sleeve relative to the cylindrical outer tube into an activation force upon the valve operable to selectively release the flow of defense substance. The rotation-based torque transmission assembly includes an activation pin operable to apply the activation force upon the valve, an actuator plate attached to the activation pin, and a cam ring rotationally attached to the activation sleeve and including at least one slanted ramp, wherein, when the cam ring is rotated, the slanted ramp acts upon the actuator plate and causes the activation pin to apply the activation force upon the valve.

In some embodiments, the activation pin includes a hollow center, and the flow of defense substance is channeled to exit the valve and enter the hollow center.

In some embodiments, the activation pin includes a nozzle operable to direct the flow of defense substance into an effective flow pattern outside of the defense substance spray canister.

According to one alternative embodiment, a defense substance spray canister is disclosed. The defense substance spray canister includes a cylindrical outer tube defining a longitudinal axis of the defense substance spray canister through an axial center of the cylindrical outer tube, a defense substance storage container contained within the cylindrical outer tube, the defense substance storage container including a valve operable to selectively release a flow of defense substance, an activation sleeve centered upon the longitudinal axis and, based upon torque applied to the activation sleeve, operable to activate the valve, and a rotation-based torque transmission assembly operable to transform the torque applied to the activation sleeve into an activation force upon the valve operable to selectively release the flow of defense substance. The rotation-based torque transmission assembly includes an activation pin operable to apply the activation force upon the valve, an actuator plate attached to the activation pin, and a cam ring rotationally attached to the activation sleeve and including at least one slanted ramp, wherein, when torque is applied to the activation sleeve, the slanted ramp acts upon the actuator plate and causes the activation pin to apply the activation force upon the valve.

In some embodiments, the activation pin includes a hollow center, and the flow of defense substance is channeled to exit the valve and enter the hollow center.

In some embodiments, the activation pin includes a nozzle operable to direct the flow of defense substance into an effective flow pattern outside of the defense substance spray canister.

The above features and advantages and other features and advantages of the present disclosure are readily apparent from the following detailed description of the best modes for carrying out the disclosure when taken in connection with the accompanying drawings.

BRIEF DESCRIPTION OF THE DRAWINGS

FIG. 4 illustrates in perspective view the cam ring of the sleeve force transmission assembly of FIG. 3, in accordance with the present disclosure;

FIG. 5 illustrates in perspective view the actuator restrainer of the sleeve force transmission assembly of FIG. 3, in accordance with the present disclosure;

DETAILED DESCRIPTION

A device is provided for dispensing defense substance from the device for the purpose of self-defense. The device is configured to be stored in plain sight without presenting potentially threatening or scare-inducing firearm-imitating trigger mechanisms.

A number of different defense substances can be utilized with the disclosed canister. For example, any substance including pepper spray (oleoresin capsicum), tear gas (0-chlorobenzylidenemalononitrile or 2-chlorobenzalmalononitrile), or other similar compounds can be utilized. A defense substance can be in any one various states, including a sprayed liquid, a pressurized gas, or a deployable gel in accordance with the disclosure.

The device disclosed herein may include a cylindrical or elongated shape, with a central longitudinal axis being defined through a center of the cylinder. In one embodiment, a spray hole from which defense substance can be made to emanate is located at or near the longitudinal axis of the device and the defense substance emanating from the device is initially oriented coaxially with longitudinal axis.

Figure 1:
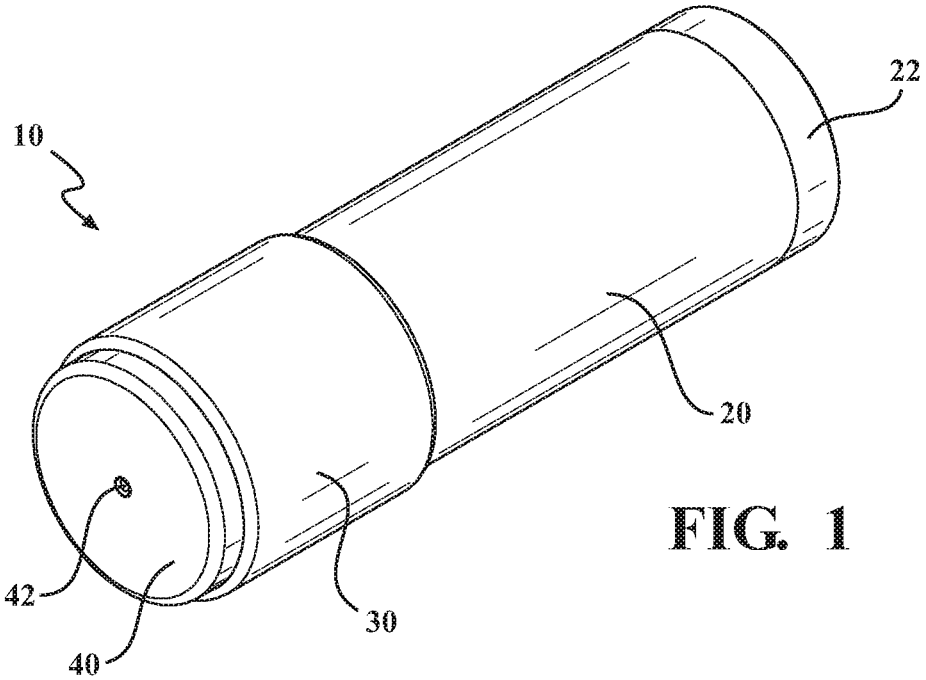
FIG. 1 illustrates in perspective view an exemplary defense substance spray canister, in accordance with the present disclosure.

FIG. 1 illustrates in perspective view an exemplary defense substance spray canister. Defense substance spray canister 10 is illustrated including outer tube 20, bottom cap 22, activation sleeve 30, and top cap 40. Outer tube 20 is provided including an exemplary cylindrical shape, although other shapes can be utilized, for example, providing for stylistic or ergonomic shapes. Bottom cap 22 is exemplary and provides an ability to unscrew or otherwise remove bottom cap 22 to access a defense substance storage container there within. In one embodiment, bottom cap 22 can enable the defense substance storage container to be maintained or replaced. In another embodiment, outer tube 20 can be sealed or capped at the end illustrated with bottom cap 22. Top cap 40 includes spray hole 42 from which a spray, jet, or other emanation of defense substance can be selectively activated to flow from.

Activation sleeve 30 is illustrated as an annular band formed around and/or situated co-axially with outer tube 20. In the event that outer tube 20 has a circular cross section, activation sleeve 30 can be configured to turn relative to outer tube 20 in order to selectively activate the defense substance function. In other embodiments, activation sleeve 30 can be configured to be moved in either direction longitudinally relative to outer tube 20 to selectively activate the defense substance function. By moving activation sleeve 30 relative to outer tube 20, a user can selectively activate the defense substance function of the device.

Figure 2:
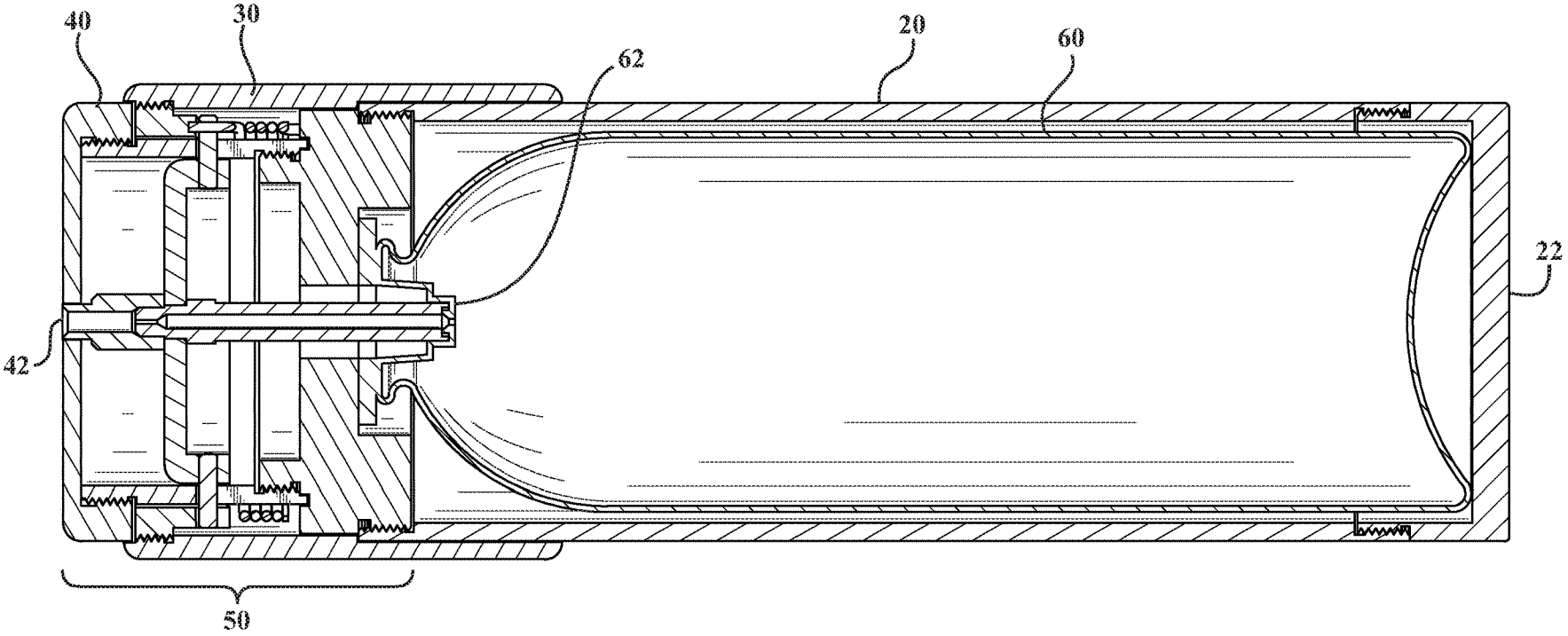
FIG. 2 schematically illustrates in cross-sectional view the defense substance spray canister of FIG. 1, in accordance with the present disclosure.

FIG. 2 schematically illustrates in cross-sectional view the defense substance spray canister of FIG. 1. The defense substance spray canister is illustrated including outer tube 20, bottom cap 22, activation sleeve 30, top cap 40 including spray hole 42, defense substance storage container 60, and sleeve force transmission assembly 50. Defense substance storage container 60 is a dispensing device in the art capable of storing a liquid under pressure and selectively dispensing the liquid based upon actuation of a valve. Defense substance storage container 60 includes valve 62 configured to dispense a flow of defense substance when components of valve 62 are compressed.

Figure 3:
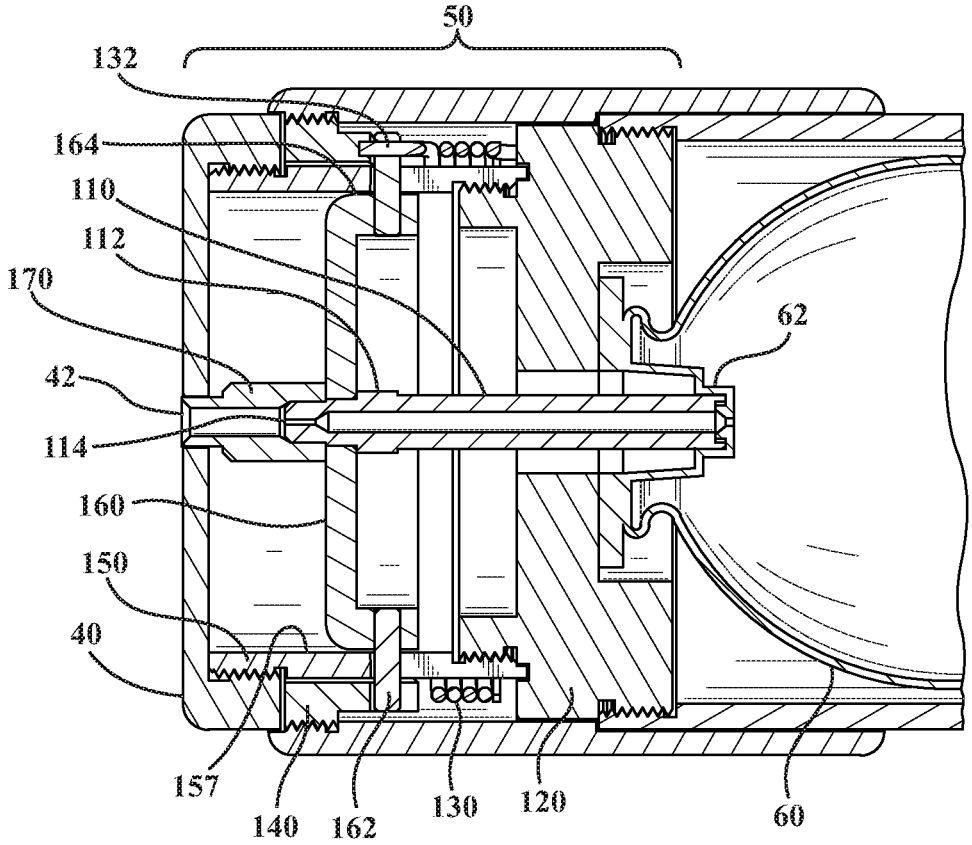
FIG. 3 schematically illustrates in cross-sectional view the sleeve force transmission assembly of FIG. 2 in increased scale, in accordance with the present disclosure.

FIG. 3 schematically illustrates in cross-sectional view the sleeve force transmission assembly of FIG. 2 in increased scale. Sleeve force transmission assembly 50 is illustrated including cam ring 140, actuator restrainer 150, actuator plate 160, torsion spring 130, and bottle stop 120. In the embodiment of FIG. 3, sleeve force transmission assembly includes a rotation-based torque transmission assembly operable to convert or transform a torque applied to activation sleeve 30 or relative rotation of activation sleeve 30 in relation to outer tube 20 of FIG. 3 into an activation force upon valve 62. Activation sleeve 30 is fastened to cam ring 140, such that when a user turns activation sleeve 30 relative to the outer tube of the device, cam ring 140 similarly turns. Turning of cam ring 140 causes slanted ramp structures of cam ring 140 to move relative to pins 162 attached to actuator plate 160. As the slanted ramp structures of cam ring 140 turn with cam ring 140, pins 162 are displaced longitudinally toward defense substance storage container 60. As pins 162 are displaced, actuator plate 160 to which pins 162 are fastened or connected is similarly displaced toward defense substance storage container 60. Actuator pin 110 is illustrated including a shoulder ring 112 around a middle portion, wherein the shoulder ring 112 is engaged to actuator plate 160, such that displacement of actuator plate 160 toward defense substance storage container 60 causes actuator pin 110 to displace toward defense substance storage container 60.

Displacement of actuator pin 110 causes it to press upon valve 62 of defense substance storage container 60 thereby causing defense substance storage container 60 to dispense a flow of defense substance. Actuator pin 110 is hollow in a center, and actuator pin 110 is situated over an opening of valve 62 such that the flow of defense substance being dispensed from defense substance storage container 60 flows into and through the hollow center of actuator pin 110. Actuator pin 110 additionally includes a nozzle feature 114 configured to direct the defense substance being dispensed in an effective flow pattern. Actuator pin 110 fits matingly within spray hole fitting 170. Spray hole fitting 170 includes a hole configured to slidingly receive a forward end of actuator pin 110, wherein actuator pin 110 can move longitudinally relative to spray hole fitting 170 while still being contained within the hole of spray hole fitting 170. By actuator pin 110 remaining within the hole of spray hole fitting 170, the flow of defense substance flowing through the hollow center of actuator pin 110 flows out of actuator pin 110 and into the hole of spray hole fitting 170. The hole of spray hole fitting 170 continues to a forward tip of spray hole fitting 170 and is open to an outside of the device, such that the flow of defense substance flowing through spray hole fitting 170 emanates from the hole as a defense substance jet for use by the user against an attacker.

Torsion spring 130 is situated to apply torsional force and thereby rotating bias to cam ring 140 and activation sleeve 30. Torsion spring 130 biases cam ring 140 and activation sleeve 30 toward a non-activated state, wherein no flow of defense substance emanates from spray hole 42. When a user turns or applies torque to activation sleeve 30, torsion spring 130 is rotated or compressed, and at some threshold angle of rotation of activation sleeve 30 relative to the outer tube of the device, the activation sleeve 30 reaches an activated state, and defense substance flows from spray hole 42.

Actuator restrainer 150 includes a plurality of longitudinally oriented channels, through which pins 162 can be made to traverse as activation sleeve 30 and cam ring 140 force pins 162 to displace in the direction of defense substance storage container 60. Additionally, an outer diameter 164 of actuator plate 160 is flush with an inner diameter 157 of actuator restrainer 150. Together, pins 162 being within channels of actuator restrainer 150 and outer diameter 164 being flush with inner diameter 157 restrict motion of actuator plate 160 generally in a longitudinally oriented forward position and a longitudinally oriented rearward position. Actuator restrainer 150 is fastened to bottle stop 120. Top cap 40 is fastened to an end of actuator restrainer 150. Bottle stop 120 is fastened to outer tube 20 and is operable to securely hold defense substance storage container 60 in place.

FIG. 4 illustrates in perspective view the cam ring of the sleeve force transmission assembly of FIG. 3. Cam ring 140 is illustrated including exemplary threading 141 configured to enable connection of cam ring 140 to activation sleeve 30 of FIG. 3. It will be appreciated that threading 141 can be operable to securely tighten cam ring 140 to activation sleeve 30 in a same direction that activation sleeve 30 is turned to cause defense substance to emanate from the device, such that activating the device cannot cause activation sleeve 30 to unthread from cam ring 140. Cam ring 140 includes four slanted ramp structures 143 operable to act upon pins 162 of FIG. 3, such that rotation of cam ring 140 causes longitudinal movement of pins 162 and connected actuator plate 160. Cam ring 140 can additionally include torsion spring anchor hole 145 which can be used to attach torsion spring 130 of FIG. 3, such that rotation of cam ring 140 can be rotationally biased by torsion spring 130.

FIG. 5 illustrates in perspective view the actuator restrainer of the sleeve force transmission assembly of FIG. 3. Actuator restrainer 150 is illustrated including threading 153 operable to attach to bottle stop 120 and threading 151 operable to attach to top cap 40. Actuator restrainer 150 includes a plurality of longitudinally oriented channels 155 operable to contain and guide pins 162 of FIG. 3 restraining and thereby guiding actuator plate 160 through longitudinal motion as disclosed herein.

Figure 6:
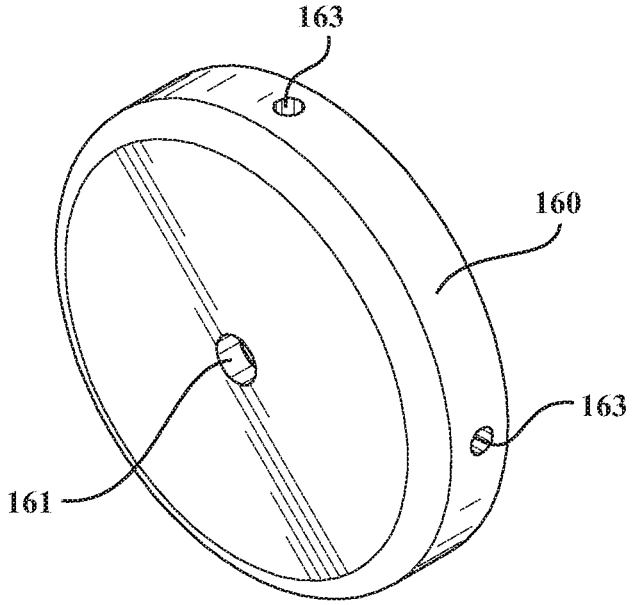
FIG. 6 illustrates in perspective view the actuator plate of the sleeve force transmission assembly of FIG. 3, in accordance with the present disclosure.

FIG. 6 illustrates in perspective view the actuator plate of the sleeve force transmission assembly of FIG. 3. Actuator plate 160 is illustrated including holes 163 configured to receive and fasten with pins 162 of FIG. 3. Actuator plate 160 further includes center hole 161 configured to receive actuator pin 110. Center hole 161 is sized such that the shoulder in the middle portion of actuator pin 110 of FIG. 3 cannot fit through center hole 161, thereby enabling force applied to actuator plate 160 to be transmitted to actuator pin 110.

Figure 7:
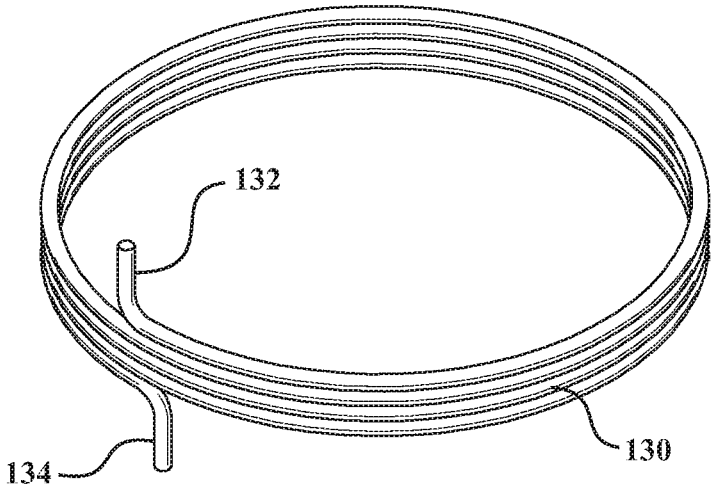
FIG. 7 illustrates in perspective view the torsion spring of the sleeve force transmission assembly of FIG. 3, in accordance with the present disclosure.

FIG. 7 illustrates in perspective view the torsion spring of the sleeve force transmission assembly of FIG. 3. Torsion spring 130 is illustrated including a plurality of stacked loops of metallic material. In one embodiment, the metallic material can be spring steel. Torsion spring 130 includes a first anchor tab 134 and a second anchor tab 132. First anchor tab 134 and second anchor tab 132 each enable torsion spring to be affixed to a first feature and a second feature, respectively, and create a rotational bias between the two features.

Figure 8:
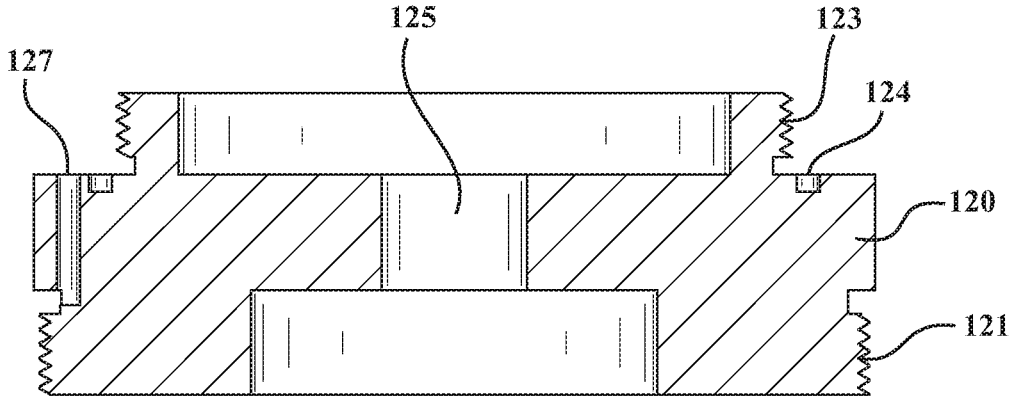
FIG. 8 schematically illustrates in cross-sectional view the bottle stop of the sleeve force transmission assembly of FIG. 3, in accordance with the present disclosure.
Figure 9:
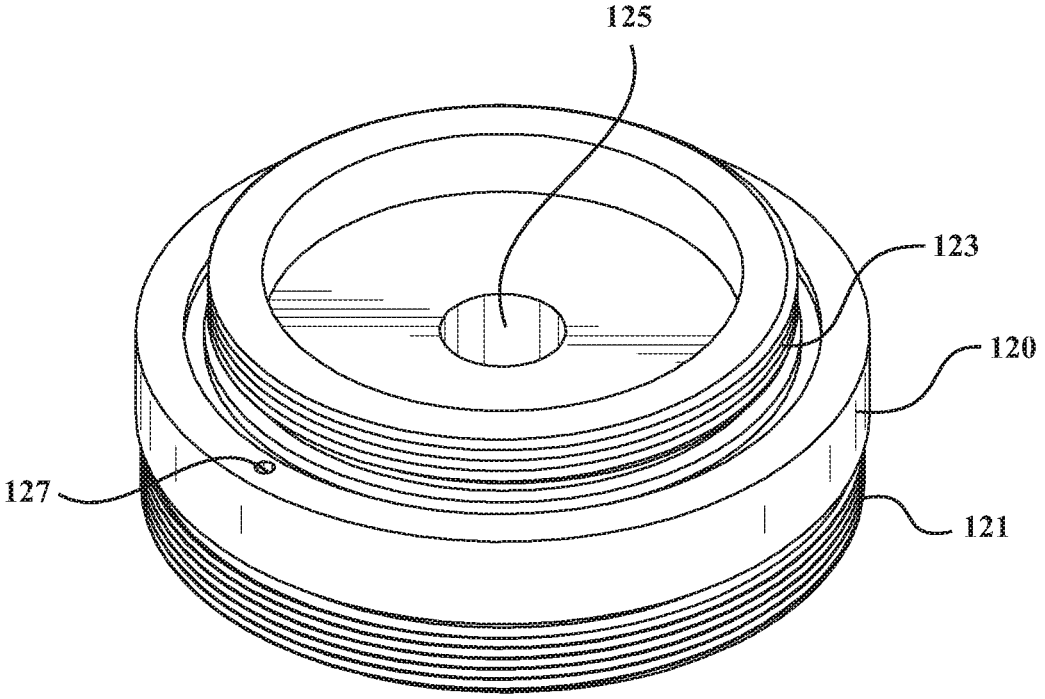
FIG. 9 illustrates in perspective view the bottle stop of FIG. 8, in accordance with the present disclosure.

FIG. 8 schematically illustrates in cross-sectional view the bottle stop of the sleeve force transmission assembly of FIG. 3. Bottle stop 120 is illustrated including threading 121 configured to attach to outer tube 20 and threading 123 configured to attach to actuator restrainer 150. Bottle stop 120 additionally may include groove 124 configured to align actuator restrainer 150. Bottle stop 120 is configured to hold defense substance storage container 60 of FIG. 2 in place and includes center hole 125 configured to permit actuator pin 110 to extend through bottle stop 120 to engage with valve 62 or defense substance storage container 60. Bottle stop 120 may additionally include torsion spring anchor hole 127 which can be used to attach torsion spring 130 of FIG. 3, such that rotation of cam ring 140 relative to bottle stop 120 can be rotationally biased by torsion spring 130. FIG. 9 illustrates in perspective view the bottle stop of FIG. 8. Bottle stop 120 is illustrated including threading 121, threading 123, center hole 125, and torsion spring anchor hole 127.

Figure 10:
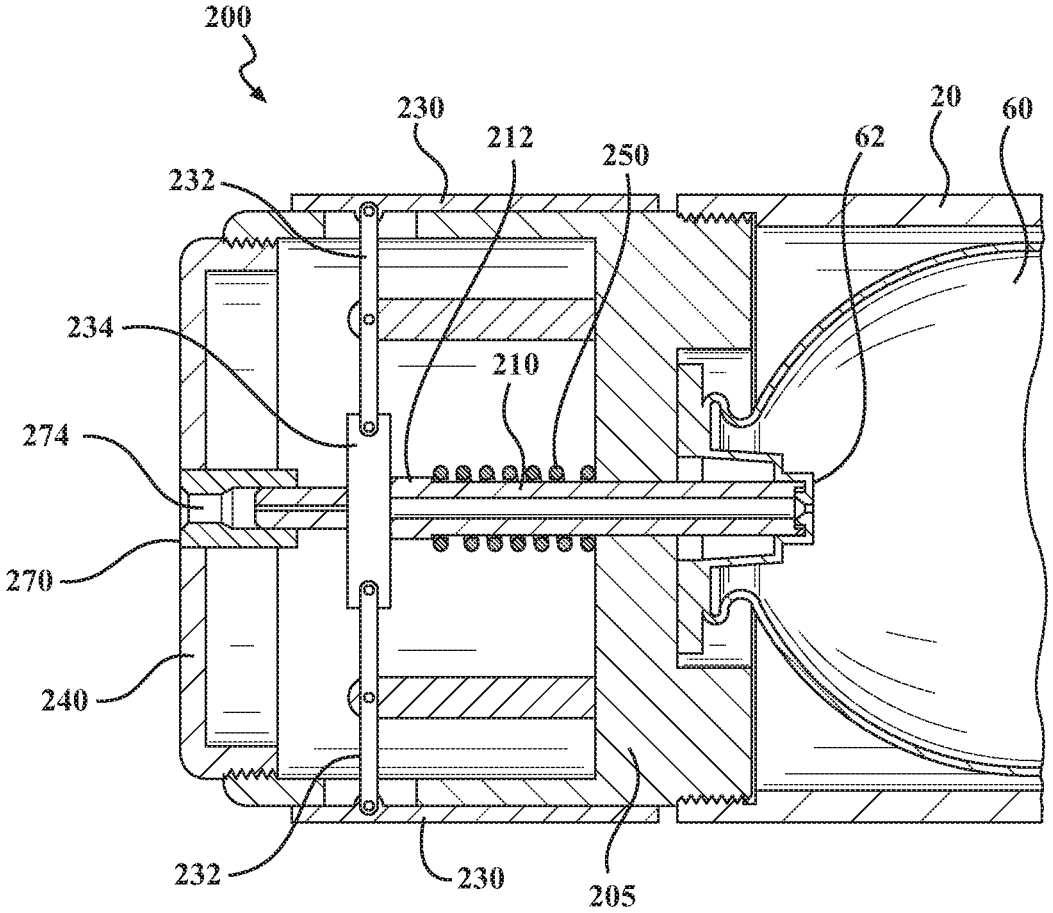
FIG. 10 schematically illustrates in cross-sectional view an alternative exemplary embodiment of an exemplary defense substance spray canister, in accordance with the present disclosure.

FIG. 10 schematically illustrates in cross-sectional view an alternative exemplary embodiment of an exemplary defense substance spray canister. Defense substance spray canister 200 is illustrated including outer tube 30, defense substance storage container 60 including valve 62, and activation sleeve 230. A sleeve force transmission assembly can be described as a longitudinal-based force transmission assembly. The sleeve force transmission assembly includes pivoting arms 232 attached to activation sleeve 230, a longitudinally translating actuator member 234, and actuator pin 210. Longitudinal movement of activation sleeve 230 results in pivoting of pivoting arms 232 which results in longitudinal translation of translating actuator member 234. Actuator pin 210 includes sleeve 212 in a middle portion of actuator pin 210. Sleeve 212 contacts a bottom surface of translating actuator member 234, such that sleeve 212 cannot pass through a hole in translating actuator member 234. As a result, when pivoting arms 232 force translating actuator member 234 to move toward defense substance storage container 60, actuator pin 210 correspondingly moves toward defense substance storage container 60 and can apply an activation force upon valve 62. Return spring 250 can be included to bias actuator pin 210, translating actuator member 234, and activation sleeve 230 into a non-activated state.

Bottle stop member 205 is provided and may include threading to attach to outer tube 20. Bottle stop member 205 is operable to hold defense substance storage container 60 in place and additionally may include threading to attach to top cap 240. Bottle stop member 205 can include features to enable pivoting arms 232 to pivot around fixed points upon bottle stop member 205.

Displacement or translation of actuator pin 210 causes actuator pin 210 to press upon valve 62 of defense substance storage container 60 thereby causing defense substance storage container 60 to dispense a flow of defense substance. Actuator pin 210 is hollow in a center, and actuator pin 210 is situated over an opening of valve 62 such that the flow of defense substance being dispensed from defense substance storage container 60 flows into and through the hollow center of actuator pin 210. Actuator pin 210 fits matingly within spray hole fitting 270. Spray hole fitting 270 includes a hole configured to slidingly receive a forward end of actuator pin 210, wherein actuator pin 210 can move longitudinally relative to spray hole fitting 270 while still being contained within the hole of spray hole fitting 270. Spray hole fitting 270 additionally includes a nozzle feature 274 configured to direct the defense substance being dispensed in an effective flow pattern. By actuator pin 210 remaining within the hole of spray hole fitting 270, the flow of defense substance flowing through the hollow center of actuator pin 210 flows out of actuator pin 210 and into the hole of spray hole fitting 270. The hole of spray hole fitting 270 continues to a forward tip of spray hole fitting 270 and is open to an outside of the device, such that the flow of defense substance flowing through spray hole fitting 270 emanates from the hole as a defense substance jet for use by the user against an attacker.

While the best modes for carrying out the disclosure have been described in detail, those familiar with the art to which this disclosure relates will recognize various alternative designs and embodiments for practicing the disclosure within the scope of the appended claims.

What is claimed is:

1. A defense substance spray canister, comprising:

a cylindrical outer tube defining a longitudinal axis of the defense substance spray canister through an axial center of the cylindrical outer tube;

a defense substance storage container contained within the cylindrical outer tube, the defense substance storage container including a valve operable to selectively release a flow of defense substance;

an activation sleeve centered upon the longitudinal axis and, based upon relative movement of the activation sleeve relative to the cylindrical outer tube, operable to activate the valve; and a sleeve force transmission assembly operable to transform the relative movement of the activation sleeve relative to the cylindrical outer tube into an activation force upon the valve operable to selectively release the flow of defense substance; and wherein the sleeve force transmission assembly comprises a longitudinal-based force transmission assembly including:

two pivoting arms connected to the activation sleeve;

a translating actuator member connected to the two pivoting arms; and an activation pin operable to apply the activation force upon the valve based upon movement of the translating actuator member.

2. A defense substance spray canister, comprising:

a cylindrical outer tube defining a longitudinal axis of the defense substance spray canister through an axial center of the cylindrical outer tube;

a defense substance storage container contained within the cylindrical outer tube, the defense substance storage container including a valve operable to selectively release a flow of defense substance;

an activation sleeve centered upon the longitudinal axis and, based upon relative rotation of the activation sleeve relative to the cylindrical outer tube, operable to activate the valve; and a rotation-based torque transmission assembly operable to transform the relative rotation of the activation sleeve relative to the cylindrical outer tube into an activation force upon the valve operable to selectively release the flow of defense substance, the rotation-based torque transmission assembly comprising:

an activation pin operable to apply the activation force upon the valve;

an actuator plate attached to the activation pin; and a cam ring rotationally attached to the activation sleeve and including at least one slanted ramp, wherein, when the cam ring is rotated, the slanted ramp acts upon the actuator plate and causes the activation pin to apply the activation force upon the valve.

3. The defense substance spray canister of claim 2, wherein the rotation-based torque transmission assembly further comprises a torsion spring operable to bias the activation sleeve into a non-activated state.

4. The defense substance spray canister of claim 2, wherein the cylindrical outer tube comprises a removeable bottom cap.

5. The defense substance spray canister of claim 2, wherein the defense substance storage container contains oleoresin capsicum.

6. The defense substance spray canister of claim 2, wherein the defense substance storage container contains tear gas.

7. The defense substance spray canister of claim 2, wherein the activation pin includes a hollow center; and wherein the flow of defense substance is channeled to exit the valve and enter the hollow center.

8. The defense substance spray canister of claim 7, wherein the activation pin comprises a nozzle operable to direct the flow of defense substance into an effective flow pattern outside of the defense substance spray canister.

9. A defense substance spray canister, comprising:

a cylindrical outer tube defining a longitudinal axis of the defense substance spray canister through an axial center of the cylindrical outer tube;

a defense substance storage container contained within the cylindrical outer tube, the defense substance storage container including a valve operable to selectively release a flow of defense substance;

an activation sleeve centered upon the longitudinal axis and, based upon torque applied to the activation sleeve, operable to activate the valve; and a rotation-based torque transmission assembly operable to transform the torque applied to the activation sleeve into an activation force upon the valve operable to selectively release the flow of defense substance, the rotation-based torque transmission assembly comprising:

an activation pin operable to apply the activation force upon the valve;

an actuator plate attached to the activation pin; and a cam ring rotationally attached to the activation sleeve and including at least one slanted ramp, wherein, when torque is applied to the activation sleeve, the slanted ramp acts upon the actuator plate and causes the activation pin to apply the activation force upon the valve.

10. The defense substance spray canister of claim 9, wherein the activation pin includes a hollow center; and wherein the flow of defense substance is channeled to exit the valve and enter the hollow center.

11. The defense substance spray canister of claim 10, wherein the activation pin comprises a nozzle operable to direct the flow of defense substance into an effective flow pattern outside of the defense substance spray canister.

* * * * *